US005788570A

United States Patent [19]

Cho

[11] Patent Number: 5,788,570

[45] Date of Patent: Aug. 4, 1998

[54] WIND DIRECTION CONTROL APPARATUS AND METHOD FOR AN AIR CONDITIONER

[75] Inventor: Jae-Seok Cho, Seoul, Rep. of Korea

[73] Assignee: Samsung Electronics Co., Ltd., Suwon, Rep. of Korea

[21] Appl. No.: 850,823

[22] Filed: May 2, 1997

[30] Foreign Application Priority Data

Sep. 3, 1996 [KR] Rep. of Korea ..... 96-38004

[51] Int. Cl.[6] ..... F24F 13/15

[52] U.S. Cl. ..... 454/233; 454/315; 454/320; 454/324

[58] Field of Search ..... 454/202, 233, 454/234, 313, 319, 320, 321, 324, 334

[56] References Cited

U.S. PATENT DOCUMENTS 4,890,545 1/1990 Matsuda et al. ..... 454/313 X 5,461,875 10/1995 Lee et al. ..... 454/236 X

FOREIGN PATENT DOCUMENTS 63-286650 11/1988 Japan ..... 454/233

*Primary Examiner*—Harold Joyce

*Attorney, Agent, or Firm*—Burns, Doane, Swecker & Mathis, L.L.P.

[57] ABSTRACT

An air conditioner includes an air inlet, an air outlet, and a heat exchanger. The air outlet has adjustable air direction control blades extending thereacross enabling a direction of discharged air to be set by a user. The blades are adjusted by a motor. When the air conditioner is shut-off, a controller memory stores the position of the blades and then moves the blades to a closed state. Upon re-starting the air conditioner, the controller drives the motor to return the blades to their previous (memorized) position.

4 Claims, 11 Drawing Sheets

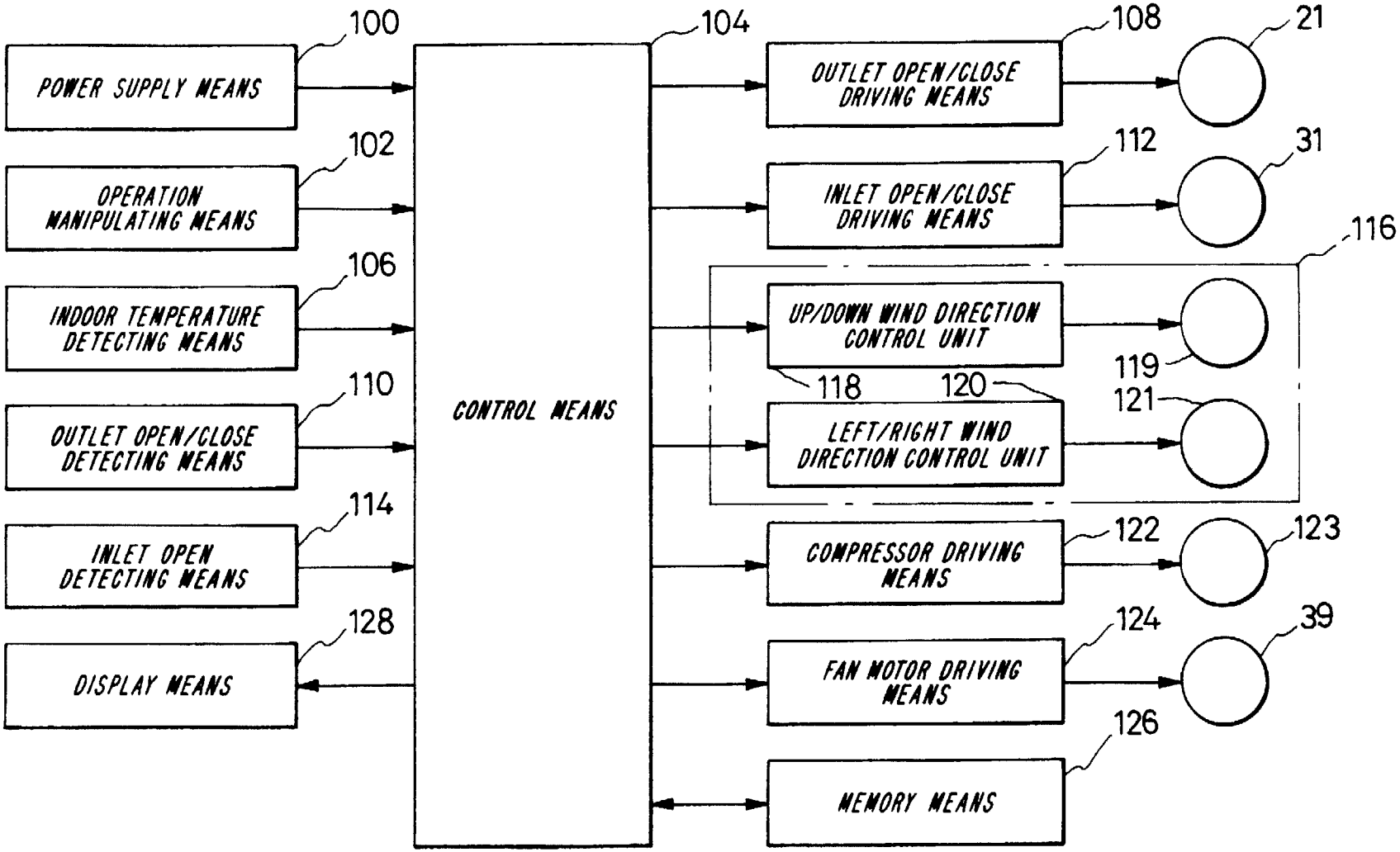
FIG. 7
POWER SUPPLY MEANS
OPERATION MANIPULATING MEANS
INDOOR TEMPERATURE DETECTING MEANS
OUTLET OPEN/CLOSE DETECTING MEANS
INLET OPEN DETECTING MEANS
DISPLAY MEANS
CONTROL MEANS
OUTLET OPEN/CLOSE DRIVING MEANS
INLET OPEN/CLOSE DRIVING MEANS
UP/DOWN WIND DIRECTION CONTROL UNIT
LEFT/RIGHT WIND DIRECTION CONTROL UNIT
COMPRESSOR DRIVING MEANS
FAN MOTOR DRIVING MEANS
MEMORY MEANS
100
102
106
110
114
128
104
108
112
116
118
119
120
121
122
123
124
126
21
31
39

FIG. 8
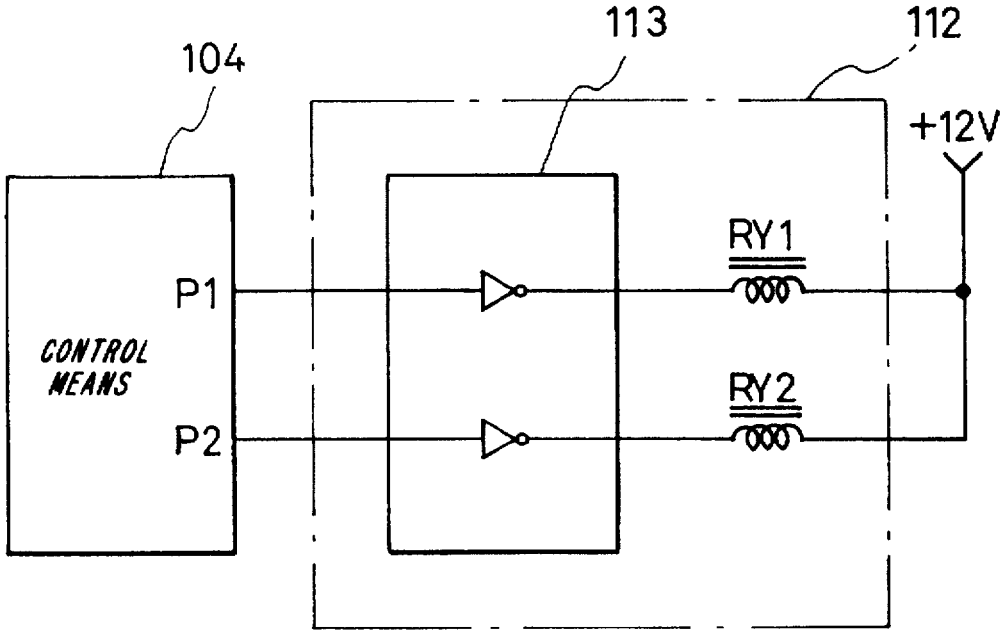
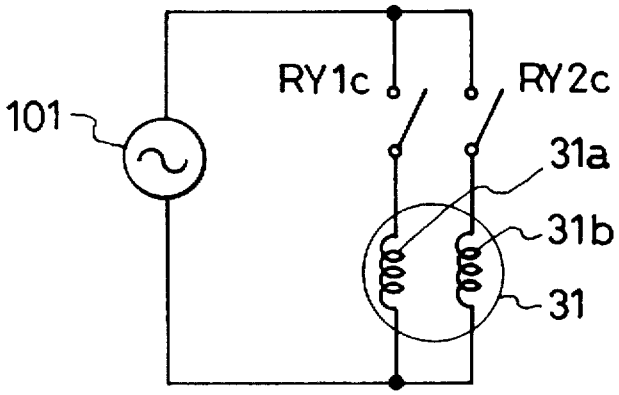

WIND DIRECTION CONTROL APPARATUS AND METHOD FOR AN AIR CONDITIONER

BACKGROUND OF THE INVENTION

1. Field of the Invention

This invention relates to an air conditioner having wind direction blades for controlling the direction of discharged air, and more particularly to a wind direction control apparatus for controlling the positions of those blades.

2. Description of the Prior Art

As shown in FIGS. 1 and 2, an indoor unit 1 of a conventional air conditioner has an inlet grill member 5 including a plurality of inlets 3 through which room air is sucked and has outlet 7 formed at a frontal upper part thereof for discharging the air heat-exchanged as cold wind or hot wind after being sucked through the inlet 3.

Further, there are installed at the outlet 7 horizontal blades 9 for vertically controlling the direction of the air discharged through the outlet 7 and vertical blades 11 for horizontally controlling a direction of the air. There is installed inside the outlet 7 an outlet door 13 to open the outlet 7 so that the air heat-exchanged in a heat exchanger(not shown) is discharged into a room smoothly and to close the outlet 7 both for preventing dust and harmful materials from flowing into the indoor unit 1 during an operation stand-by condition and for improving an external appearance thereof.

A cover member 15 is fixed at a frontal part of the indoor unit 1 both for design purposes and for protecting inner elements of the apparatus; and a control panel 17 is equipped at a lower side of the cover member 15 for selecting operational modes (auto, cooling, defrosting, air blowing, heating or the like), start/stop operation, discharge amount and wind directions of the air discharged through the outlet 7 of the air conditioner.

As shown in FIG. 3, drive means for vertically moving the outlet door 13 includes a support member 19 fixed at a frontal upper part of the indoor unit 1, an outlet motor 21 fixed by the support member 19 for generating torque for vertically moving the outlet door 13, a pinion 23 coupled with a shaft 22 of the outlet motor 21 to be revolved by the outlet motor 21, and a rack 25 engaged with the pinion 23 to vertically move the outlet door 13 by converting rotation of the pinion 23 into linear movement of the outlet door 13 when the pinion 23 is reotated.

In addition, drive means for rotating the horizontal blade 9 comprises a wind direction control motor 27 (e.g. a stepping motor) installed inside the indoor unit 1 and a plurality of link members 29 operated by the wind direction control motor 27 to thereby rotate the plurality of horizontal blade 9 simultaneously.

In an air conditioner as constructed above, when a user selects an operational mode by manipulating a remote controller or a control panel 17 and turns on a start/stop key (hereinafter referred to as "start key"), the outlet motor 21 is driven in a normal direction. Then, the pinion 23 coupled with the shaft 22 of the outlet motor 21 is revolved and the rack 25 engaged therewith is moved downward, so that the outlet door 13 coupled with the rack 25 descends to open the outlet 7.

At this time, if a door open/close detecting sensor attached at a location above or below the outlet 7 detects a complete opening of the outlet 7, the outlet motor 21 stops and an indoor fan (not shown) is revolved to suck the room air into the indoor unit 1 of the air conditioner through the inlet 3. And the air inhaled through inlet 3 passes through a heat exchanger not shown and is heat-exchanged by latent evaporative heat of coolant flowing in the heat exchanger.

The air heat exchanged through the heat-exchanger is guided upward and is discharged into the room through the outlet 7. The discharged air direction is controlled in accordance with angles of the horizontal blades 9 and vertical blades 11 to thereby accomplish the air-conditioning of the room.

A control method of the prior art to vertically adjust a discharging direction of the air using the horizontal blades 9 is to twice manipulate an operational key equipped at the control panel 17 for operating the horizontal blades 9 to an "on" position. That is, if the key is manipulated one time at its on-position, the wind direction motor 27 is driven and the plurality of link members 29 are consecutively operated to swing the horizontal blades 9. And when the operational key is manipulated once again at its on-position, it turns off the wind direction motor 27 and stops the horizontal blades 9.

If a user turns off the operational key during the normal operation of the air conditioner as above, the outlet motor 21 is driven reversely. Then the pinion 23 is operated to move the rack 25 upward to thereby elevate the outlet door 13 and close the outlet 7.

At this time, when a door open/close sensor attached above or below the outlet 7 detects complete closure of the outlet 7, the outlet motor 21 is stopped and the air conditioner assumes a condition of operation stand-by.

However, the air conditioner as described above can not memorize the positions of the wind direction blades 9 and 11 prior to the shut off-operation, and is thus unable to return the blades to the prior orientation whenever a user turns on the air conditioner again. Therefore, the air conditioner is inconvenient to use because a user must adjust the directions of the horizontal blades 9 and the vertical blades 11 by manipulating the operation keys while observing positions of the blades 9 and 11 whenever he or she turns on the air conditioner.

Accordingly, it is an object of the present invention to provide a wind direction control apparatus of an air conditioner and control method therefor which can memorize positions of wind direction blades when the air conditioner is stopped and return the wind direction blades to the memorized positions automatically when the air conditioner is operated again.

SUMMARY OF THE INVENTION

The above and other objects are achieved by a wind direction control apparatus of an air conditioner according to the present invention, the apparatus comprising an inlet for inhaling room air; a heat exchanger for conditioning the air inhaled through the inlet; an outlet for discharging the air heat-exchanged in the heat exchanger; wind direction guiding blades for controlling wind direction of the air discharged through the outlet; and an outlet door opening and closing the outlet for preventing dusts and harmful materials from being flowed into the outlet, wherein the apparatus further comprises:

- operation manipulating means for inputting start and stop signals to open and close the inlet and the outlet;
- control means for controlling operation of the wind directing guiding blades according to the start and stop signals input from the operation manipulating means;
- memory means for storing the position of the wind direction guiding blades when a stop signal is input from the operation manipulating means;

drive means for wind direction guiding blades for rotating the wind direction guiding blades to the position stored in the memory means when a start signal is input from the operation manipulating means according to the control of the control means.

The wind direction control method of an air conditioner according to the present invention comprises the steps of:

memorizing the position of the wind direction guiding blades when a stop signal is input from the operation manipulating means;

identifying whether a start or stop signal is input from operation manipulating means;

rotating the wind direction guiding blades to the position stored in the memory means when a start signal is input from the operation manipulating means by driving the driving means;

opening and closing the inlet and the outlet by controlling the drive means when the wind direction guiding blades are rotated upward;

accomplishing the air-conditioning by discharging the heat-exchanged air to a room according to an established temperature and an established wind amount when the wind direction guiding blades have rotated to the position stored in the memory means.

BRIEF DESCRIPTION OF THE DRAWINGS

For a fuller understanding of the nature and objects of the invention, reference should be made to the following detailed description taken in conjunction with the accompanying drawings in which:

FIG. 7 is a control block diagram of an operational control apparatus according to the embodiment of the present invention;

FIG. 8 is an electric circuit of inlet open/close driving means according to the present invention; and FIGS . 9A to 9C are flow charts respectively showing operational sequences of an air conditioner according to the present invention.

DESCRIPTION OF THE PREFERRED EMBODIMENT

Figure 1:
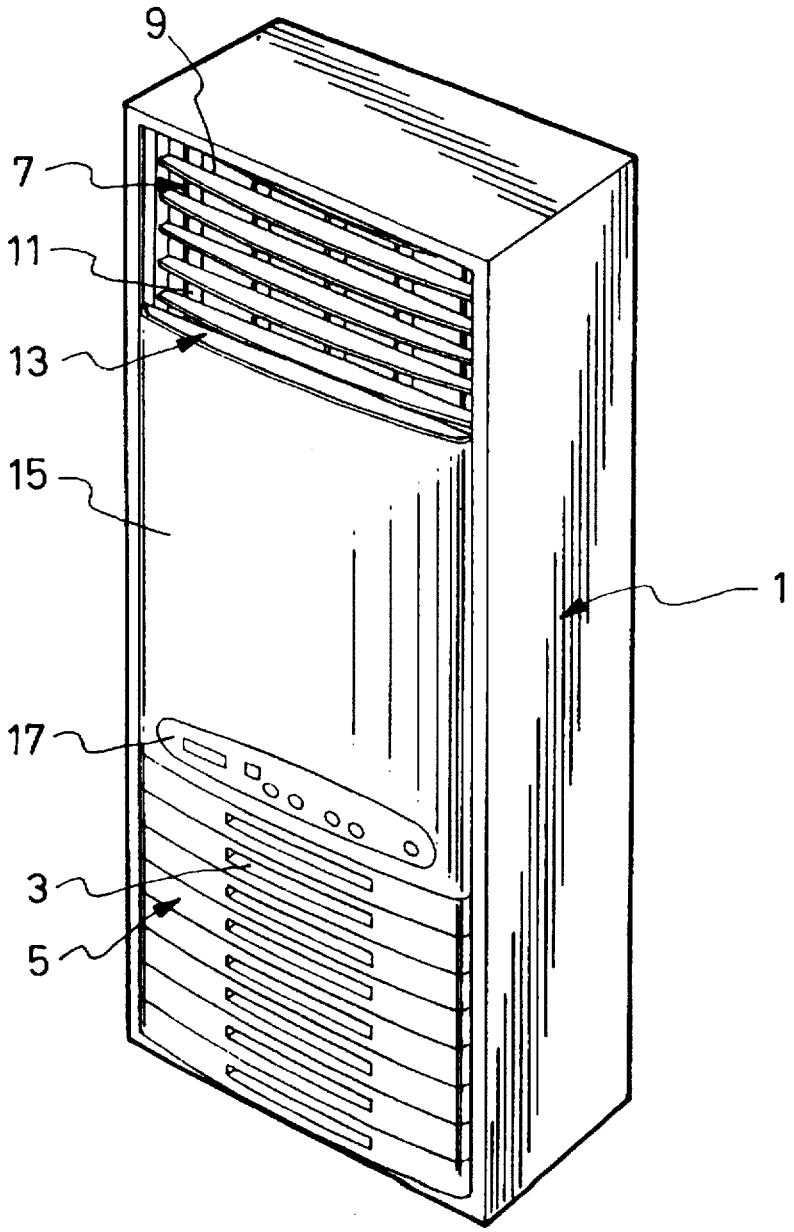
FIG. 1 (PRIOR ART)
FIG. 1 is a top front perspective view showing an air conditioner according to the prior art when an air outlet is open.
Figure 2:
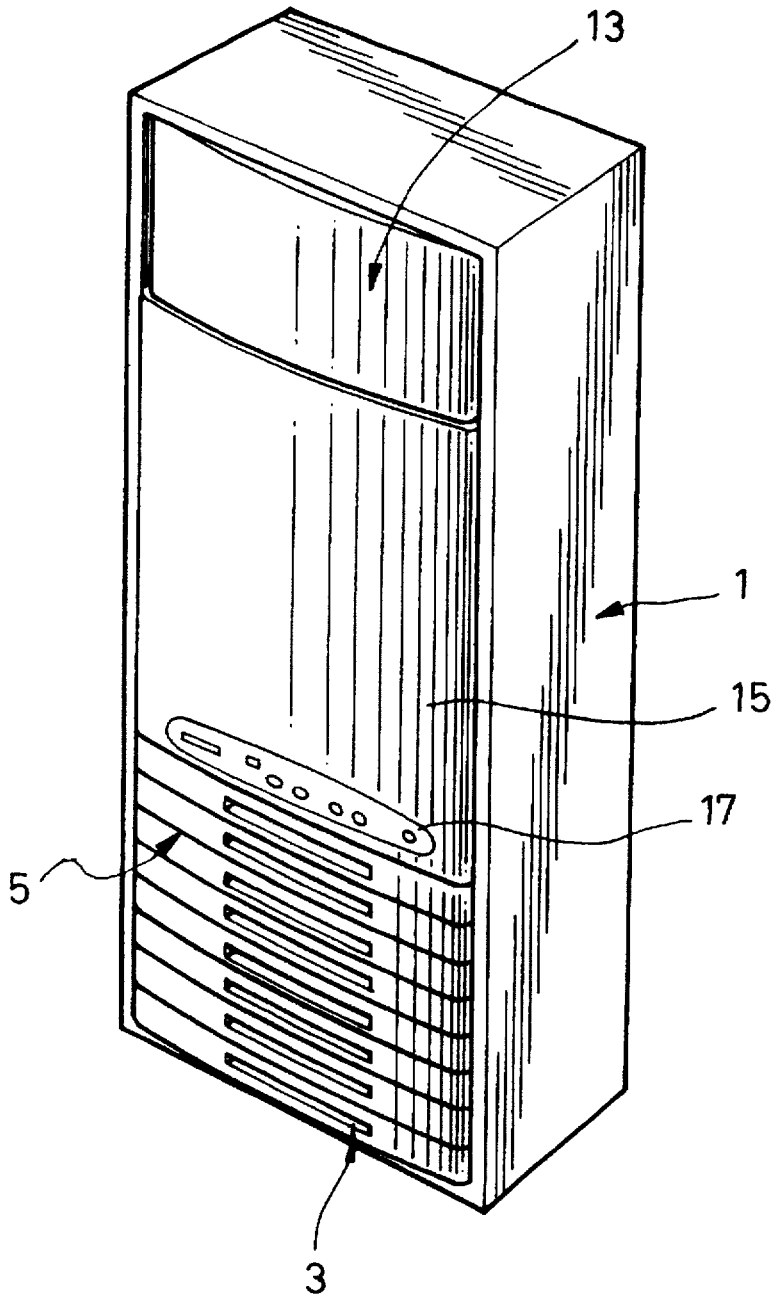
FIG. 2 (PRIOR ART)
FIG. 2 shows the air conditioner of FIG. 1 wherein the outlet is closed.
Figure 3:
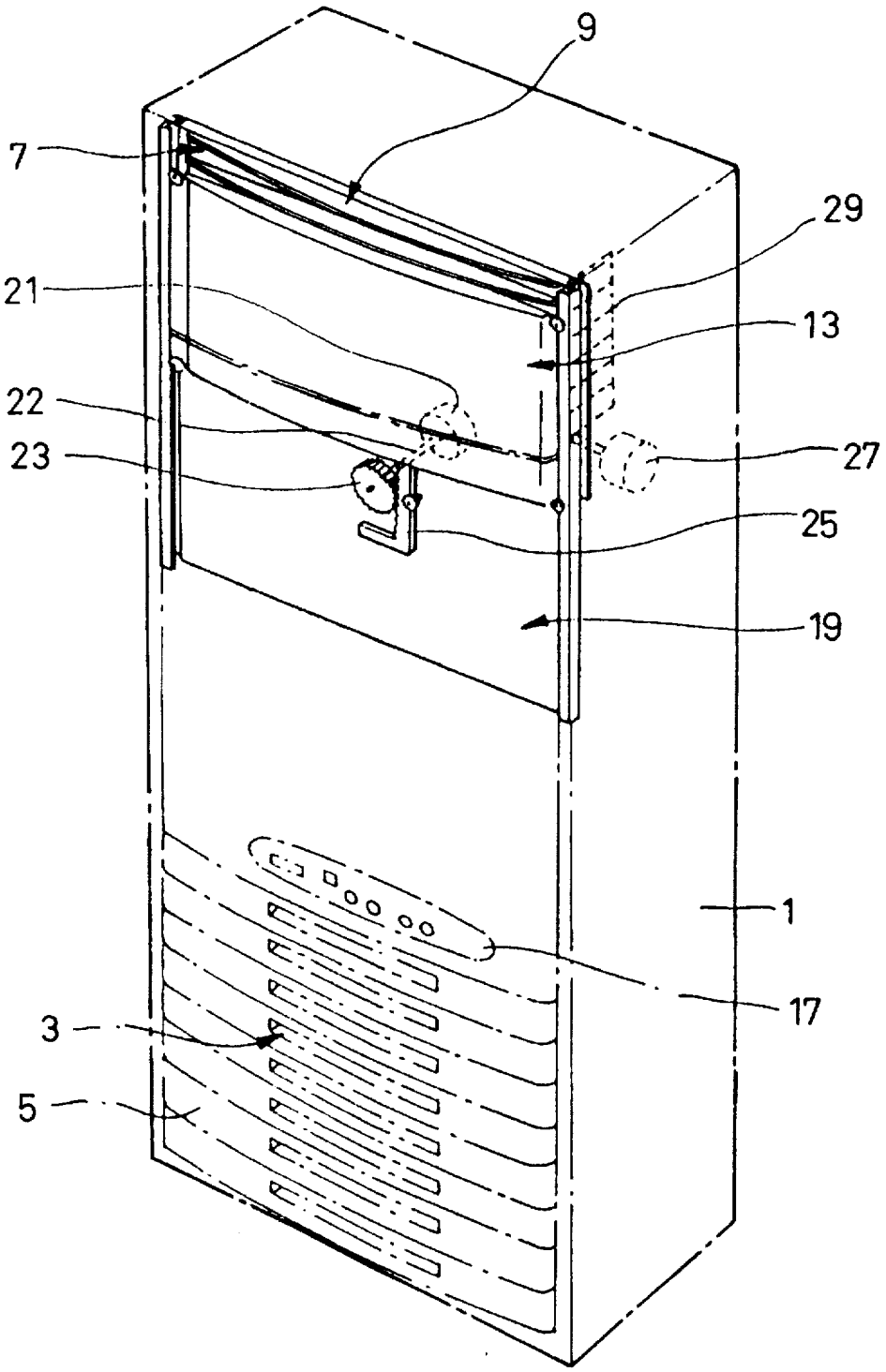
FIG. 3 (PRIOR ART)
FIG. 3 is a top front perspective view schematically showing an inner construction of an air conditioner according to the prior art.

A preferred embodiment of the present invention will now be described in detail with reference to the accompanying drawings.

Throughout the drawings, like reference numerals are used for designating like elements or parts similar to those of the air conditioner of the prior art and the repeated description thereof will be omitted for simplicity of illustration and explanation.

Figure 4:
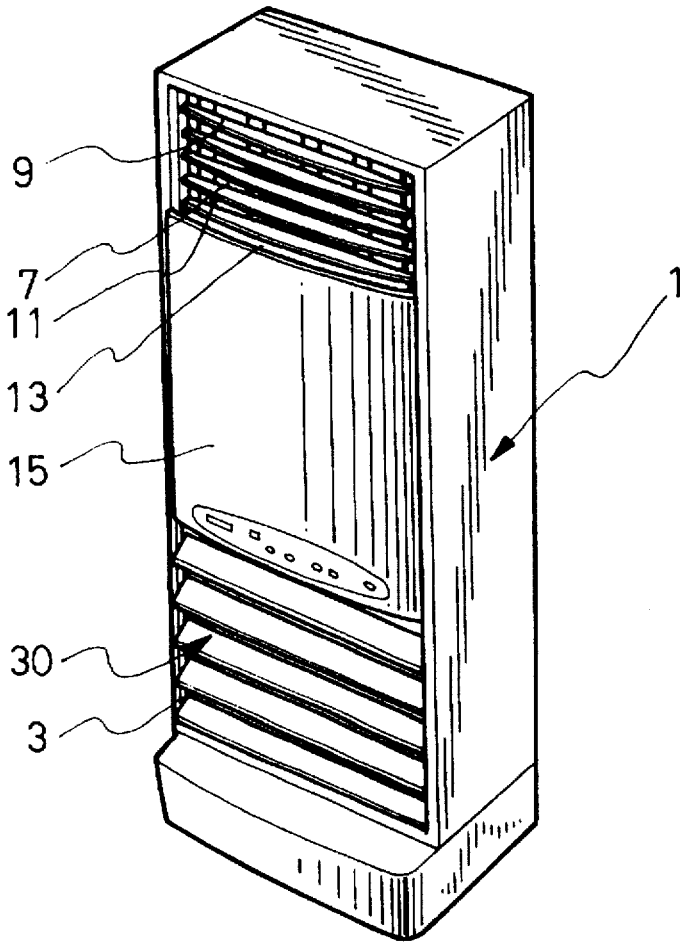
FIG. 4 is a top front perspective view showing an air conditioner according to an embodiment of the present invention.

As shown in FIG. 4, inlet open/close means 30 is installed at an inlet 3 formed at a lower part of an indoor unit 1 to open the inlet 3 so that the room air can be inhaled smoothly through the inlet 3 upon operating an air conditioner, and to close the inlet 3 so that dust and harmful materials can be prevented from entering the indoor unit 1 and at the same time to provide an aesthetic appearance while the air conditioner is in a stand-by condition (not operated).

Figure 5:
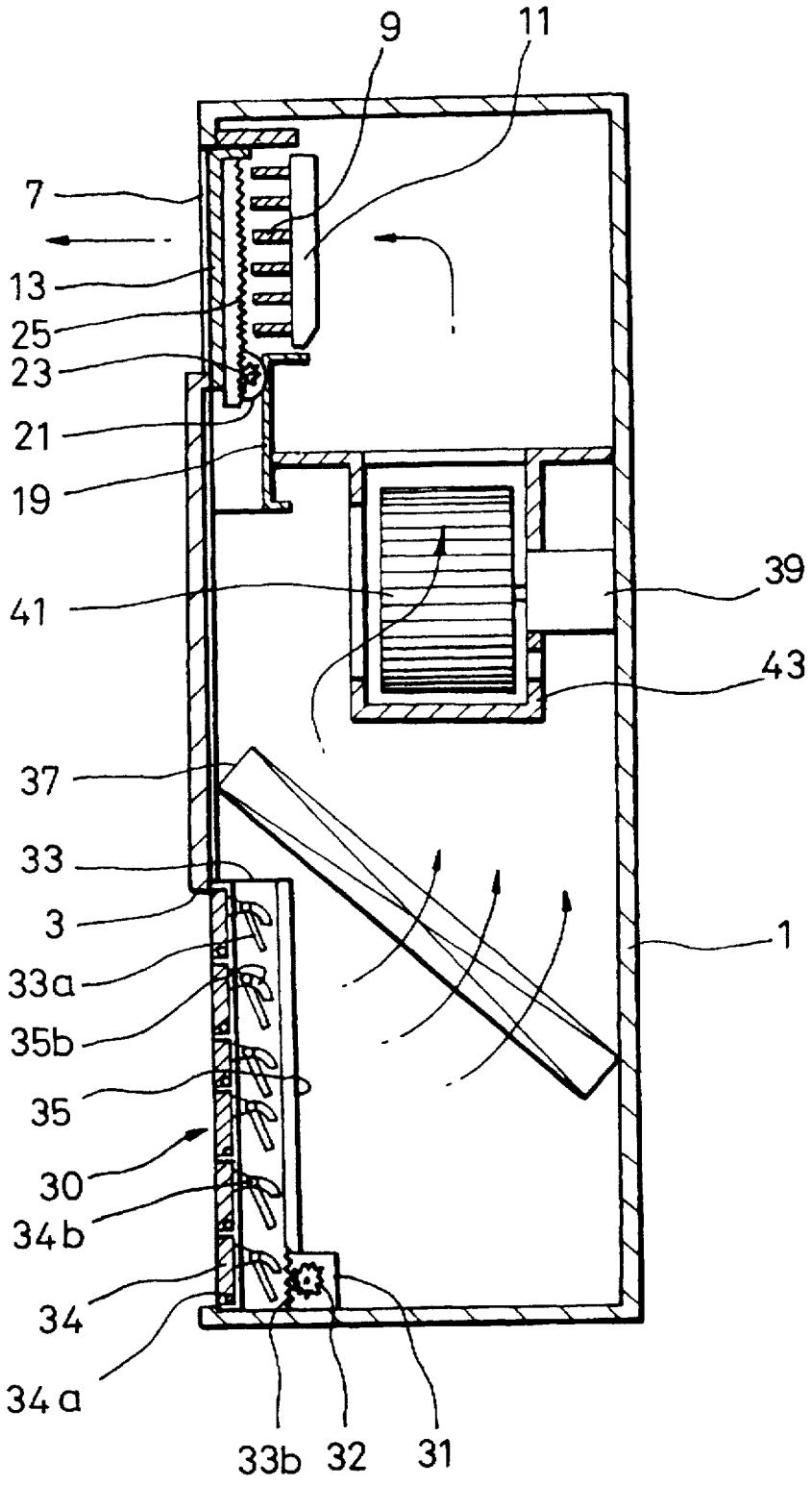
FIG. 5 is a vertical cross sectional view through the air conditioner of FIG. 4 wherein an inlet and an outlet are closed.

As shown in FIG. 5, the inlet open/close means 30 comprises an inlet motor 31 for generating a driving torque for opening or closing the inlet 3; a pinion for being rotated forward or backward by torque transmitted from the inlet motor 31, a slide member 33 engaged with the pinion 32 and moving upward or downward according to a rotational orientation of the pinion 32; an inlet grill 34 formed by blades linked with the slide member 33 and rotated according to translational movement of the slide member 33; and guide members 35 installed at both side ends of the inlet grill 34 for supporting the inlet grill 34 to rotate freely and at the same time for guiding the inlet grill 34 to be opened or closed.

A heat exchanger 37 is installed downstream of the inlet open/close means 30 in order to heat-exchange the room air inhaled through the inlet 3 as cold wind or hot wind, and an indoor fan 41 driven by an indoor fan motor 39 is installed over the heat exchanger 37 for inhaling the room air through the inlet 3 and at the same time for discharging the air to the room through the outlet 7.

Further, a duct 43 is installed around the indoor fan 41 in order to cover the indoor fan 41 and at the same time to guide the air flow inhaled through the inlet 3 and discharged to room through the outlet 7.

Figure 6:
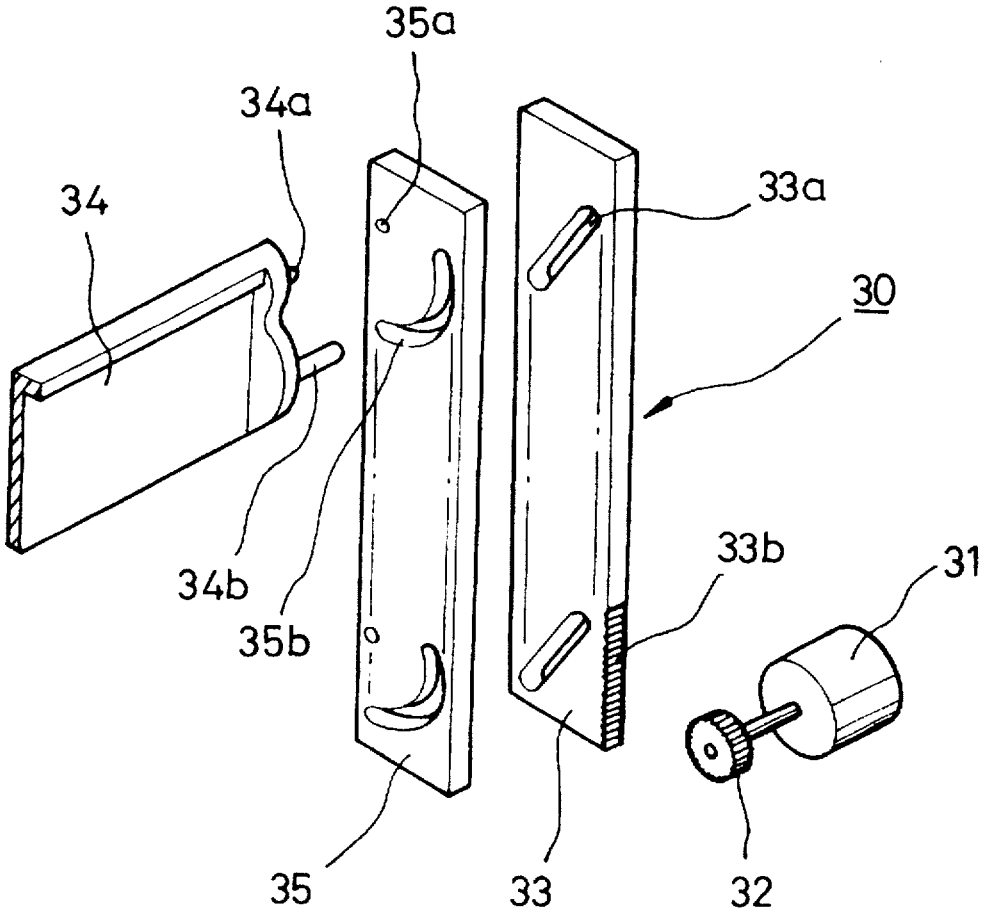
FIG. 6 is a perspective exploded view showing principal elements according to the present invention.

As shown in FIG. 6, hinge shafts **34*a* for supporting the inlet grill 34 to revolve freely are installed at both side ends of the inlet grill 34, and protrusions 34*b* formed at a side of the hinge shaft 34*a* are slidably disposed in a groove 33*a* formed in the slide member 33**.

In addition, a fixing hole **35*a* to retain the hinge shafts 34*a* for free rotation is formed in a guide member 35, and an arch-shaped guide hole 35*b* is formed next to the fixing hole 35*a*. The protrusions 34*b* are rotated in accordance with the translational movement of the slide member 33, and a gear rack 33*b* is formed in an edge of the slide member 33 to be engaged with the pinion 32**.

An electric circuit to control an open/close operation of the outlet door 13 and a vertical movement of the horizontal blades 9 in the air conditioner structured as above will be explained with reference to FIGS. 7 and 8.

As shown FIGS. 7 and 8, a power supply means 100 serves to transform commercial A.C. voltage supplied from an A.C. power source 101 to a predetermined D.C. voltage necessary for operating the air conditioner. Operation manipulating means 102 is equipped with a start/stop key (hereinafter referred to as "start key") as well as a plurality of function keys for selecting drive modes (auto, cooling, defrosting, air blowing, heating or the like), wind amount of air discharged through the outlet 7 (strong wind, weak wind, breeze and the like) and desired temperature (Ts: hereinafter referred to as "established temperature").

A control means 104 is provided in the form of a microcomputer for initializing an operational condition of the air conditioner by receiving the D.C. voltage output from the power source 100 and controlling an overall operation of the air conditioner according to a selection signal input to the operation manipulating means 102. The control means 104 serves to control D.C. current applied to the inlet motor 31 for opening or closing the outlet door 13 and for opening or closing the inlet grill 34, and, at the same time, to count a close-driving time duration of the inlet motor 31 to control a close operation of the inlet grill 34.

Indoor temperature detecting means 106 detects a current indoor temperature(Tr) from the room air being inhaled through the inlet 3 in order to control the indoor temperature to an established temperature(Ts) by actuating the air conditioner. And outlet open/close driving means 108 receives a start/stop signal output from the control means 104 when an operation start or stop signal is input, and controls the driving of the outlet motor 21 to vertically move the outlet door 13.

Further, outlet open/close detecting means 110 senses whether the outlet 7 is opened or closed according to an open/close position of the outlet door 13 which is vertically moving according to operation of the outlet open/close driving means 108, and outputs the detected signal to the control means 104.

Inlet open/close drive means 112 receives a control signal output from the control means 104 when the operation start signal or the operation stop signal is input by the operation manipulating means 102 and also controls the driving of the inlet motor 31 in order to move the inlet grill 34 for opening and closing the inlet 3. The inlet open/close drive means 112 comprises an inverter IC 113 for reversing an open/close control signal of high level output from output terminals P1 and P2 of the control means 104, a relay RY1 being turned on by D.C. voltage (12 V) output from the power supply means 100 in order to forward drive the inlet motor 31 when an open control signal of low level reversed by the inverter IC 113 is output, and a relay RY2 being turned on by D.C. voltage(12 V) output from the power supply means 100 in order to reversely drive the inlet motor 31 when close control signal of low level reversed by the inverter IC 113 is output.

Inlet open detecting means 114 detects whether the inlet 3 has been opened by the inlet grill 34 according to ascent position of the slide member 33 which moves upward in accordance with the driving of the inlet motor 31, and the inlet open detecting means 114 outputs a corresponding signal to the control means 104.

Further, wind direction control means 116 serves to control the direction of the air discharged through the outlet 7 vertically and horizontally so that the wind is spread all over the room. The wind direction control means 116 comprises an up/down wind direction control unit 118 for receiving a control signal output from the control means 104 and driving an up/down wind direction motor 119 so that the horizontal blades 9 move up and down vertically; and a left/right wind direction control unit 120 for receiving a control signal output from the control means 104 and driving a left/right wind direction motor 121 so that the vertical blades 9 move left and right horizontally.

Compressor driving means 121 receives a control signal output from the control means 104 according to a difference between an established temperature(Ts) input by user and a room temperature(Tr) detected by the indoor temperature detecting means 106, and controls the driving of the compressor 123. Fan motor driving means 124 receives a control signal output from the control means 104 to ventilate the air heat exchanged in the heat exchanger 37 to the room, and controls the R.P.M. of the indoor fan motor 39 to run the indoor fan 41.

In the accompanying drawings, memory means 126 is an EEPROM for storing positions of the horizontal blades 9 and the vertical blades 11 when the air conditioner is stopped and for outputting data corresponding to the stored wind direction to input/output ports of the control means 104 through a buffer (not shown) when the air conditioner is thereafter started. Further, display means 126 displays, under the control of the control means 104, the current operational condition of the air conditioner as well as operational selection modes (auto, cooling, defrosting, air blowing, heating or the like) and an established temperature (Ts) input from the operation manipulation means 102, and a current room temperature (Tr).

The operation of the operational control apparatus of the air conditioner described above will be explained.

Figure 9A:
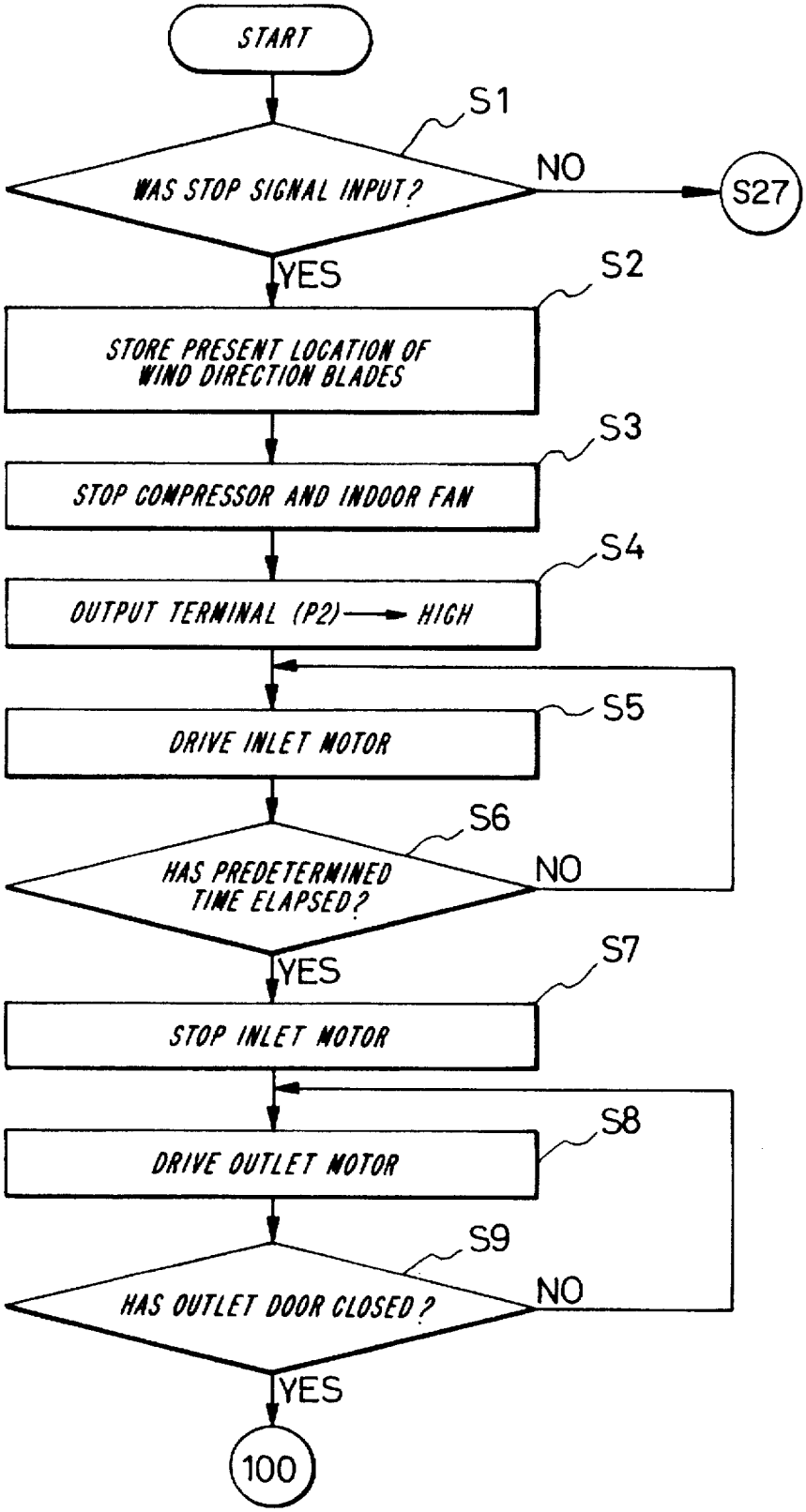
Figure 9B:
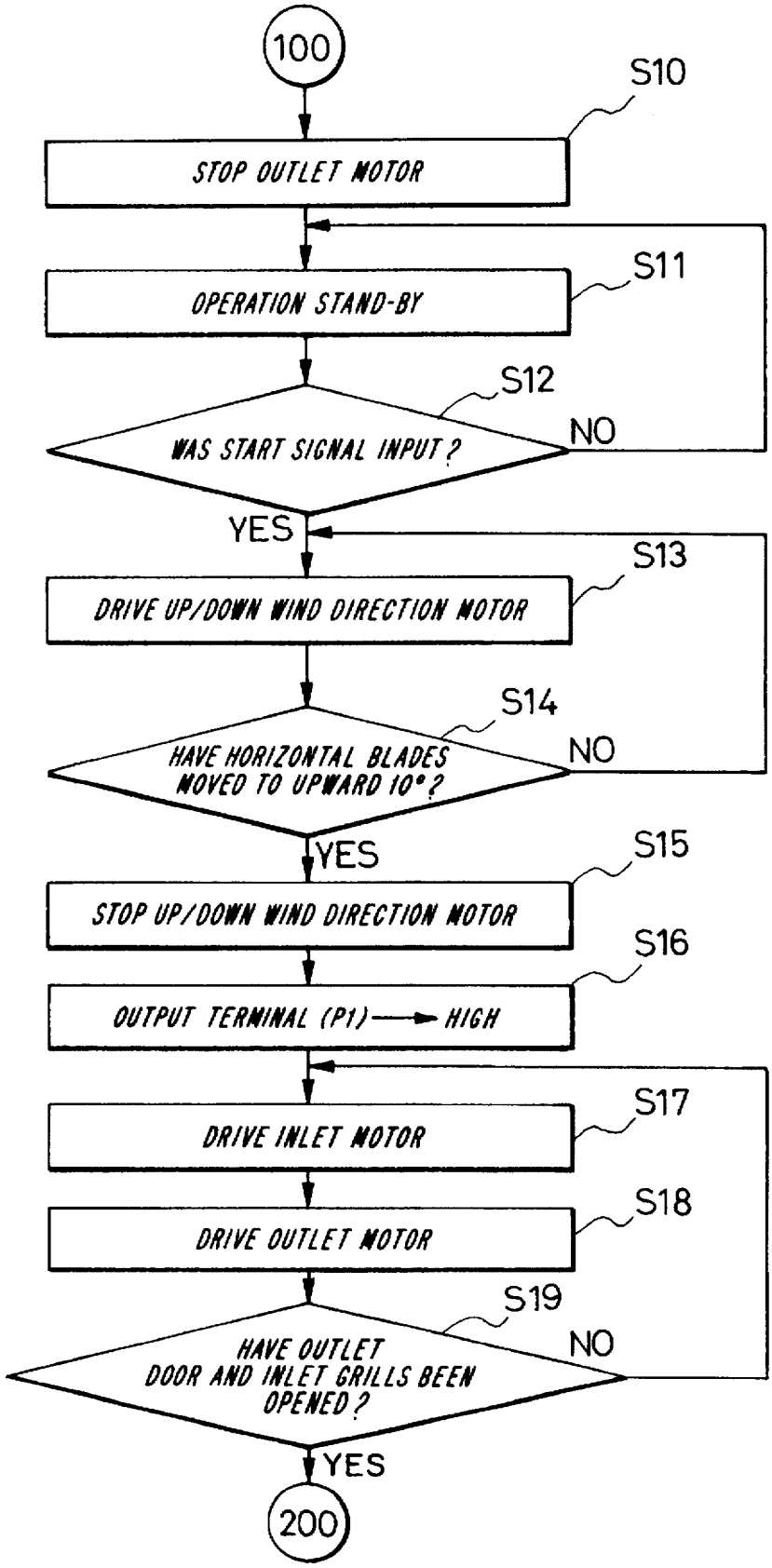
Figure 9C:
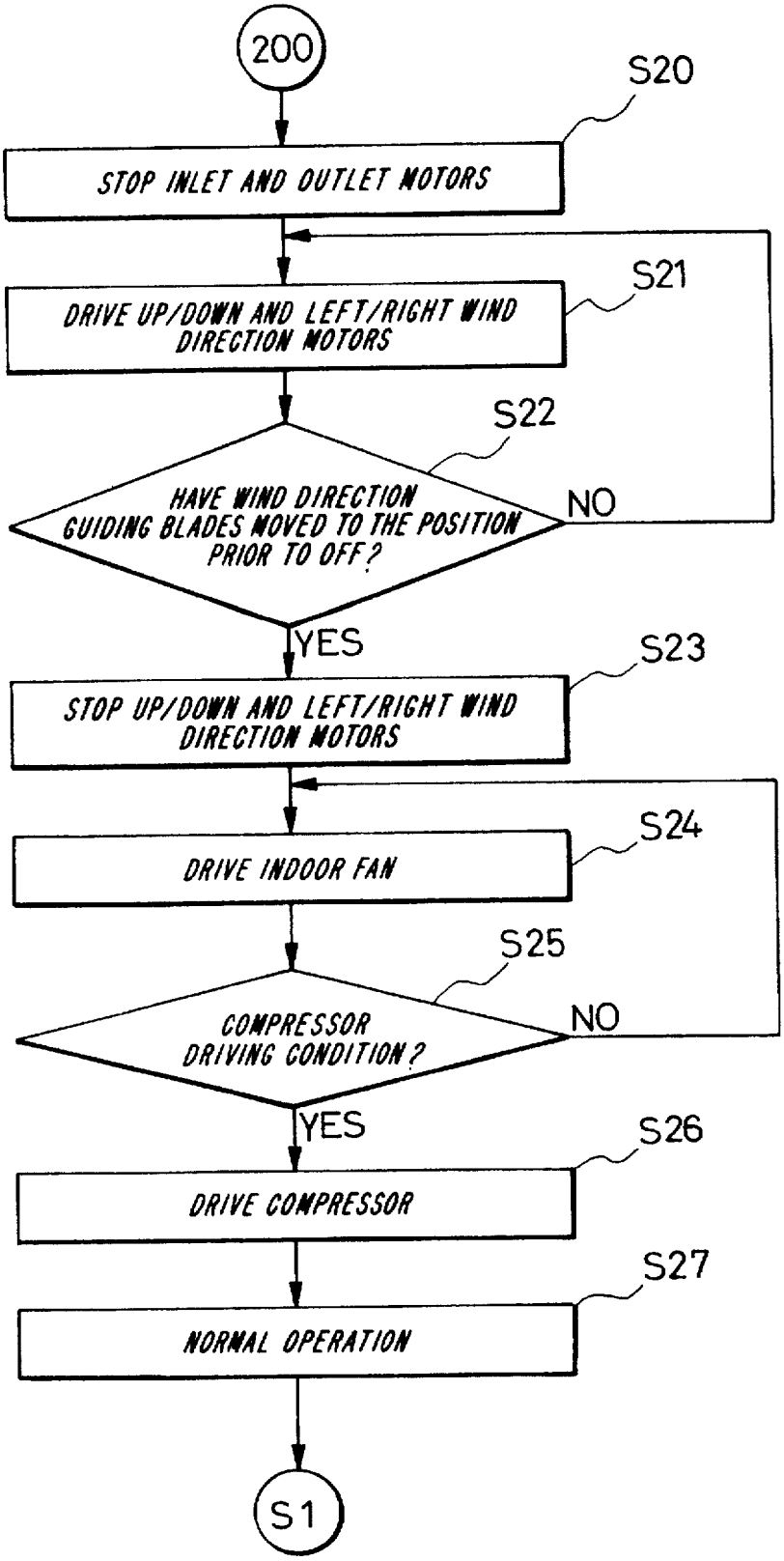

FIGS. 9A to 9C are flow charts showing operational sequences of operational control of the air conditioner according to the present invention, and S in FIGS. 9A to 9E indicates each "step".

The inlet 3 and outlet 7 are assumed open in the initial condition for explaining the operations of the air conditioner according to the present invention.

First, at step S1, the control means 104 determines whether the operation key of the drive manipulation means 102 becomes turned off and the operation stop signal is input or not while the air conditioner is in normal operation. If an operation stop signal is input (in case of "YES"), operation proceeds to step S2 at which the control means 104 stores the current positions of the horizontal and vertical blades 9 and 11 in the memory means 126 through the input/output ports.

Next, at step S3, the control means 104 outputs the control signal for stopping the compressor 123 and the indoor fan motor 39 to both the compressor driving means 122 and the fan motor driving means 124.

Accordingly, the compressor driving means 122 stops the compressor 123 according to the control of the control means 104, and the fan motor driving means 124 stops the indoor fan motor 39 according to the control of the control means 104.

And, at step S4, the control means 104 outputs a control signal of high level through an output terminal P2 to the inlet open/close driving means 112 in order to close the opened inlet 3.

Accordingly, the control signal of high level output from the output terminal P2 of the control means 104 is inverted to low level through an inverter IC 113, and a relay RY2 is turned on by D.C. voltage (12 V) output from power supply means 100 so that contact points RY2c of the relay RY2 become closed.

If the contact points RY2c of the relay RYs are closed, the A.C. voltage from A.C. supply terminals 101 is applied to coil 31*b* of the inlet motor 31 to drive the inlet motor 31 in reverse direction at step S33. Then, the pinion 32 coupled with the shaft of the inlet motor 31 is revolved reversely, the slide member 33 engaged with a side of the pinion 32 descends and the grooves 33*a* formed slantly in the slide member 33 move downward as the slide member 33 is descending. As the grooves 33*a* are descending, the protrusions 34*b* of the inlet grill 34 are rotated while being guided by the arc shaped guide holes 35*b*, so that the inlet grill 34 is rotated by a predetermined angle to close the inlet 3.

At this time, at step S6, the control means 104 counts the close time duration of the inlet motor 31 and determines whether a predetermined time duration (data produced through experiments for the time necessary for closing the inlet grill, about 11.5 seconds) has elapsed. If the predetermined time duration has not elapsed (in case of "NO"), operation returns to the step S5 and continues to drive the inlet motor 31 until the inlet grill 34 becomes closed.

If the predetermined time duration has elapsed (in case of "YES") at the step S6, the inlet grill 34 is completely closed and operation proceeds to step S7 at which the inlet open/close driving means 112 stops driving the inlet motor 31 to complete the close operation of the inlet grill 34 according to the close signal of low level output from the output terminal P2 of the control means 104.

Then, at step S8, the control means 104 outputs the control signal for closing the opened outlet 7 to the outlet open/close driving means 108.

Accordingly, the outlet open/close driving means 108 drives the outlet motor 21 according to the control of the control means 104. The outlet motor 21 is driven reversely and the pinion 23 coupled with the shaft 22 of the outlet motor 21 is revolved to move the rack 25 and the outlet door 13 upwardly to close the outlet 7.

At this time, at step S9, an outlet open/close detecting means 110 detects the position of the outlet door 13 which is moved upward by the outlet motor 21, and the control means 104 receives the signal detected by the outlet open/close detecting means 110 to determine whether the outlet door 13 is closed or not.

If the outlet door 13 and the inlet grill 34 are not closed (in case of "NO") at step S9, it returns to step S8 and continues to drive the outlet motor 21 until the outlet door 13 is completely closed. If the outlet door 13 is closed (in case of "NO"), operation proceeds to step S38 at which the outlet open/close drive means 108 stops driving the outlet motor 21 according to the control of the control means 104 to complete the close operation of the outlet door 13.

The operation of the inlet motor 31 in the steps S5–S7 and the operation of the outlet motor 21 in the steps S8–S10 are accomplished simultaneously, but have been described in sequence for explanational convenience only.

In succession, at step S11, the control means 104 maintains the air conditioner in an operation stand-by condition until a start signal is input again from the operation manipulation means 102.

At this time, when a user manipulates the operation manipulating means 102 to input a desired operational mode (auto, cooling, defrosting, air blowing, heating or the like) of the air conditioner and to establish a desired temperature(Ts) and then presses the start key, the operation manipulating means 102 inputs an operational selection signal and an operation start signal to the control means 104.

As a result, at step S12, the control means determines whether the start signal is input from the operation manipulating means 102 or not. If the start signal is not input (in case of "No"), operation returns to step S11 to maintain the air conditioner in the operation stand-by condition and repeats the steps S1 to S11.

If the start signal is input (in case of "Yes") at step S12, the control means 104 proceeds to the step S13 and outputs driving pulses to the up/down wind direction control unit 118 for rotating the horizontal blades 9 upward to a non-obstructing position so that the outlet door 13 can be opened smoothly.

Accordingly, the up/down wind direction control unit 118 receives driving pulses output from the control means 104 and runs the up/down wind direction control motor 119, so that a plurality of link members 29 connected therewith are operated to rotate the horizontal blades 9 upward simultaneously.

At this time, at step S14, the control means 104 counts the number of pulses output when the up/down wind direction control motor 119 is driven and determines whether the horizontal blades 9 are tilted by 10° from horizontal in the upward direction or not. If the horizontal blades 9 are not rotated 10° in the upward direction (in case of "NO"), operation returns to the step S13 at which the control means 104 repeats the steps S1 to S13 until the horizontal blades 9 travel upwardly by 10° from horizontal.

It can be determined by counting the number of pulses output from the control means 104 whether the horizontal blades 9 are moved 10° in the upward direction because the number of pulses for the horizontal blades 9 to be moved 10° in the upward direction has been set within the control means 104.

However, if the horizontal blades 9 are rotated 10° in the upward direction (in case of "Yes") at step S14, operation proceeds to step S15 at which the up/down wind direction control unit 118 receives the driving pulses output from the control means 104 and stops driving the up/down wind direction control motor 119, thereby concluding the upward movement of the horizontal blades 9.

Next, at step S16, the control means 104 outputs a control signal of high level through an output terminal Pl to the inlet open/close driving means 112 in order to open the closed inlet 3.

Accordingly, the open control signal of high level output from the output terminal Pl of the control means 104 is inverted to that of low level through an inverter IC 113, and a relay RYl is turned on by D.C. voltage (12 V) output from power supply means 100 so that contact points RY1*c* of the relay RY1 are closed.

If the contact points RY1*c* of the relay RY1 are closed, the A.C. voltage, at step S17, is applied from the A.C. current supply terminals 101 to coil 31*a* of the inlet motor 31 to run the inlet motor 31 in forward direction. The pinion 32 coupled with the shaft of the inlet motor 31 is revolved, and the slide member 33 engaged with a side of the pinion 32 ascends. As the slide member 33 ascends, the groove 33*a* in the slide member 33 is moved upward. Further, as the groove 33*a* ascends, the protrusions 34*b* of the inlet grill 34 are rotated while being guided by the arc shaped guide hole 35*b*, so that the inlet grill 34 is rotated by a determined angle to open the inlet 3.

And, at step S18, the control means 104 outputs a control signal for opening the closed outlet 7 to the outlet open/close driving means 108.

Accordingly, the outlet open/close driving means 108 drives the outlet motor 21 according to the control of the control means 104, so that the outlet motor 21 is driven forward and the pinion 23 coupled with the shaft 22 of the outlet motor 21 is revolved to move the rack 25 coupled therewith downward to thereby lower the outlet door 13 coupled with the rack 25 to open the outlet 7.

At this time, at step S19, an outlet open/close detecting means 110 detects the position of the outlet door 13 which is moved downward by the outlet motor 21, and an inlet open detecting means 114 detects the position of the slide member 33 which is moved upward by the inlet motor 31.

Accordingly, the control means 104 receives signals detected by the outlet open/close detecting means 110 and the inlet open detecting means 114, and determines whether the outlet door 13 and the inlet grill 34 are opened or not. If the outlet door 13 and the inlet grill 34 are not opened (in case of "NO"), operation returns to step S17 and the outlet motor 21 and the inlet motor 31 are driven until the outlet door 13 and the inlet grill 34 are opened.

If the outlet door 13 and the inlet grill 34 are opened (in case of "YES") at step S19, operation proceeds to step S20 at which the outlet open/close drive means 108 stops driving the outlet motor 21 according to the control of the control means 104 to conclude the open operation of the outlet door 13.

And the inlet open/close drive means 112 stops driving the inlet motor 31 according to the open control signal of low level output from the output terminals P1 of the control means 104 to conclude the opening operation of the inlet grill 34.

In succession, at step S21, the control means outputs driving pulses to the up/down and left/right wind direction control units 118 and 120 in order to rotate the horizontal and vertical blades 9 and 11 to the position of wind direction which was stored in the memory means 126 when the previous operation was stopped.

Accordingly, the up/down and left/right wind direction control units 118 and 120 receive the driving pulses output from the control means 104 and energize the up/down and left/right wind direction motors 119 and 121 to rotate the plurality of horizontal and vertical blades 9 and 11 simultaneously to a position corresponding to the stored wind direction.

At this time, at step S22, the control means 104 counts the number of pulses output when the up/down and left/right wind direction motors 119 and 121 are driven and determines whether the horizontal and vertical blades 9 and 11 reach the stored positions. If the horizontal and vertical blades 9 and 11 do not reach the stored positions (in case of "NO"), operation returns to step S21 and repeats steps S1 to S21 until the horizontal and vertical blades 9 and 11 reach the position of memorized stored wind direction.

If the horizontal and vertical blades 9 and 11 reach the position of memorized wind direction (in case of "YES") at step S22, operation proceeds to step S23 at which the up/down and left/right wind direction control units 118 and 120 receive the driving pulses output from the control means 104 and stop the up/down and left/right wind direction motors 119 and 121 to thereby complete the orientation control operation of the horizontal and vertical blades 9 and 11.

Then, at step S24, the fan motor driving means 124 drives the indoor fan 41 by controlling the R.P.M. of the indoor fan motor 39 according to the control of the control means 104.

If the indoor fan 41 is driven, room air starts to be inhaled into the indoor unit 1 through the inlet 3. At this time, the indoor temperature detecting means 106 detects the indoor temperature(Tr) of the incoming air inhaled through the inlet 3.

Accordingly, at step S25, the indoor temperature(Tr) detected by the indoor temperature detecting means 106 is compared with the established temperature(Ts) set in the operation manipulating means 102 by user and it is determined whether the compressor 123 should be driven.

The compressor 123 should be driven if the indoor temperature(Tr) detected by the indoor temperature detecting means 106 is higher than the established temperature(Ts) set by user during an air-cooling operation, or if the indoor temperature(Tr) detected by the indoor temperature detecting means 106 is lower than the established temperature(Ts) set by user during an air-warming operation.

If the compressor 123 should not be driven (in case of "NO") at step S25, operation returns to step S24 and repeats operations of steps S1 to S24 while detecting the indoor temperature(Tr). If the compressor 123 should be driven (in case of "YES"), operation proceeds to step S26 at which the control means 104 determines a driving frequency of the compressor 123 according to a difference between the indoor temperature(Tr) and the established temperature(Ts) and outputs a control signal for driving the compressor 123 to the compressor driving means 122.

Accordingly, the compressor driving means 122 drives the compressor 123 according to driving frequency determined at the control means 104.

If the compressor 123 is driven, the indoor fan 41 is driven at the step S27 and the room air is inhaled into the indoor unit 1 through the inlet 3 and is heated or cooled while passing through the heat exchanger 37 by latent evaporative heat of coolant flowing in the heat exchanger 37.

The heated or cooled air is moved upward and is discharged to the room in a in a direction established by the settings of the horizontal blades 9 and the vertical blades 11, and thereby accomplishes the air-conditioning. Operation then returns to step S1.

Meanwhile, if a stop signal is not input during normal operation (in case of "NO"), operation proceeds to step S27 and repeats steps S1 to S27 while the air conditioner continues in normal operation.

As described as above, in the wind direction control apparatus of an air conditioner and control method therefor according to the present invention the positions of wind direction blades 9 and 11 are memorized when the air conditioner is stopped and the wind direction blades 9 and 11 are returned to the memorized positions automatically when the air conditioner starts operation again.

What is claimed is:

1. An air conditioner comprising:

a body forming an air inlet and an air outlet;

a heat exchanger disposed in the body for changing a temperature of air;

a fan for circulating air into the inlet, through the heat exchanger, and out through the outlet;

wind guiding blades extending across the outlet for controlling a direction of discharged air;

a blade operating mechanism for adjusting the positions of the blades;

a door movable between respective positions opening and closing the air outlet;

a door operating mechanism for opening and closing the door;

a user input means enabling a user to input control signals;

a controller operably connected to the user input means and to the blade operating mechanism and door operating mechanism for actuating the blade operating mechanism and door operating mechanism in accordance with signals received from the user input means; and a memory for storing a position of the wind guiding means in response to a stopping of air conditioner operation, the memory operably connected to the controller for returning the wind guiding means to the stored position in response to a re-starting of the air conditioner operation.

2. The air conditioner according to claim 1 wherein the blade operating mechanism includes a stepping motor.

3. A method of operating an air conditioner, the air conditioner comprising a body forming an air inlet and an air outlet; a heat exchanger disposed in the body for changing a temperature of air; a fan for circulating air into the inlet, through the heat exchanger, and through the outlet; wind guiding blades extending across the outlet for controlling a direction of discharged air; a blade operating mechanism for adjusting the positions of the blades; a door movable between respective positions for opening and closing the air outlet; a door operating mechanism for opening and closing the door; a user input means enabling a user to input control signals; a controller operably connected to the user input means and the blade operating mechanism and door operating mechanism for actuating the blade operating mechanism and door operating mechanism in accordance with signals received from the user input means; and a memory for storing positions of the wind guiding means, the method comprising the steps of:

A) actuating the door operating mechanism for opening the outlet in response to a starting of the air conditioner;

B) actuating the blade operating mechanism to position the blades in a position corresponding to a position selected by a user;

C) storing in a memory a position of the wind direction guiding blades in response to an operation stop signal being input to the user input means and moving the blades to a closed position;

D) actuating the door operating mechanism to close the outlet in response to the operation stop signal;

E) operating the door operating mechanism to open the outlet in response to a re-starting of the air conditioner; and F) actuating the blade operating mechanism to the stored position in response to a re-starting of the air conditioner.

4. The method according to claim 3 wherein the air conditioner includes blades controlled by a motor; step C comprising counting output pulses from the motor for determining a blade position.

* * * * *